US008596257B2

(12) United States Patent
Volpe

(10) Patent No.: US 8,596,257 B2
(45) **Date of Patent: *Dec. 3, 2013**

(54) ELECTRONICALLY ADJUSTED BOWSIGHT

(76) Inventor: Michael T. Volpe, Philadelphia, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/460,323

(22) Filed: Apr. 30, 2012

(65) Prior Publication Data

US 2012/0210588 A1 Aug. 23, 2012

Related U.S. Application Data

(63) Continuation of application No. 12/436,241, filed on May 6, 2009, now Pat. No. 8,166,962.

(51) Int. Cl.
*F41G 1/467* (2006.01)

(52) U.S. Cl.
USPC ..... 124/87; 33/265

(58) Field of Classification Search
USPC ..... 33/265; 124/87
See application file for complete search history.

(56) References Cited

U.S. PATENT DOCUMENTS 4,179,613 A * 12/1979 Koren ..... 250/215
4,325,190 A * 4/1982 Duerst ..... 33/265
4,543,728 A * 10/1985 Kowalski ..... 33/265
4,617,741 A * 10/1986 Bordeaux et al. ..... 33/228
4,711,036 A * 12/1987 Morris ..... 33/265
4,953,302 A * 9/1990 Gould ..... 33/265
4,984,372 A * 1/1991 Blizzard ..... 33/265
5,161,310 A * 11/1992 Stoot ..... 33/265
5,211,155 A * 5/1993 Zamojski ..... 124/25.6
5,383,278 A * 1/1995 Kay ..... 33/265
5,425,177 A * 6/1995 Pacenti ..... 33/265
5,479,712 A * 1/1996 Hargrove et al. ..... 33/265
5,575,072 A * 11/1996 Eldridge ..... 33/265
5,634,278 A * 6/1997 London ..... 42/132
5,914,775 A * 6/1999 Hargrove et al. ..... 356/3.13
6,073,352 A * 6/2000 Zykan et al. ..... 33/265
6,366,344 B1 * 4/2002 Lach ..... 356/3.1
6,796,038 B2 * 9/2004 Humphries ..... 33/265
7,162,806 B1 * 1/2007 Swiggart ..... 33/265
8,166,962 B2 * 5/2012 Volpe ..... 124/87
2010/0115778 A1 * 5/2010 Gorsuch et al. ..... 33/265

* cited by examiner

*Primary Examiner* — John Ricci
(74) *Attorney, Agent, or Firm* — Volpe and Koenig, P.C.

(57) ABSTRACT

A sight and range finder for a projectile launching device are disclosed. The range finder calculates a range between a target and a projectile launching device, and transmits a signal indicative of the range. The sight visually aligns the target with the projectile launching device. A drive assembly moves an alignment member of the sight, and at least one processor receives the signal and actuates the drive assembly to move the alignment portion a selected distance based on the range.

5 Claims, 8 Drawing Sheets

ELECTRONICALLY ADJUSTED BOWSIGHT

CROSS REFERENCE TO RELATED APPLICATION

This application is a continuation of U.S. patent application Ser. No. 12/436,241, filed May 6, 2009.

FIELD OF INVENTION

The invention relates, generally, to an improved sighting and range finding device for use with a projectile launching device, such as an archery bow, and more particularly, to an integrated range finger and bow sight. The sight adjusts automatically based on measurements recorded by the electronic range finder.

BACKGROUND

There are many factors in archery that affect trajectory and impact point of an arrow at a given distance. An archer requires a sight targeting device, and a range finder device in order to accurately predict the required trajectory of the bow for a particular target. An archer must identify the target, measure the range, and then adjust the sighting device based on the range before preparing to draw. This can be a timely and awkward process, especially when the target is not stationary. Thus, there is a need for an automatically adjusting sighting device that works in conjunction with a range finder, and allows the archer to focus on the target without having to manually adjust the sight.

SUMMARY

The present disclosure solves the problems mentioned above by providing a combination of a sight and range finder. The range finder calculates a range between a target and a projectile launching device, and transmits a signal indicating the range. The sight includes at least one alignment member that visually aligns the target with the projectile launching device. Also included is a drive assembly that moves an alignment member of the sight, and a processor that receives the signal and actuates the drive assembly to move the alignment member a selected distance based on the range.

The present disclosure also provides a bow. The bow includes a range finder that calculates a range between a target and the bow. A sight produces a visual alignment between the target and the bow, and includes a drive assembly for adjusting the visual alignment based on the range. At least one processor actuates the drive assembly to adjust the visual alignment. The bow further includes a bow frame that supports the range finder, sight, and controller.

Also disclosed is a method of adjusting a sight. The method includes providing a range finder that calculates a range between a target and a projectile launching device. The method further includes providing a sight that visually aligns the target with the projectile launching device through at least one alignment member, and at least one drive assembly that moves the at least one alignment member. At least one processor is provided, and signals from the range finder to the sight. In accordance with the method, a signal is transmitted, indicating the range from the range finder to the sight. The drive assembly is actuated, to move the alignment member to a position selected based on the range, when the sight receives the signal.

DETAILED DESCRIPTION

Figure 1:
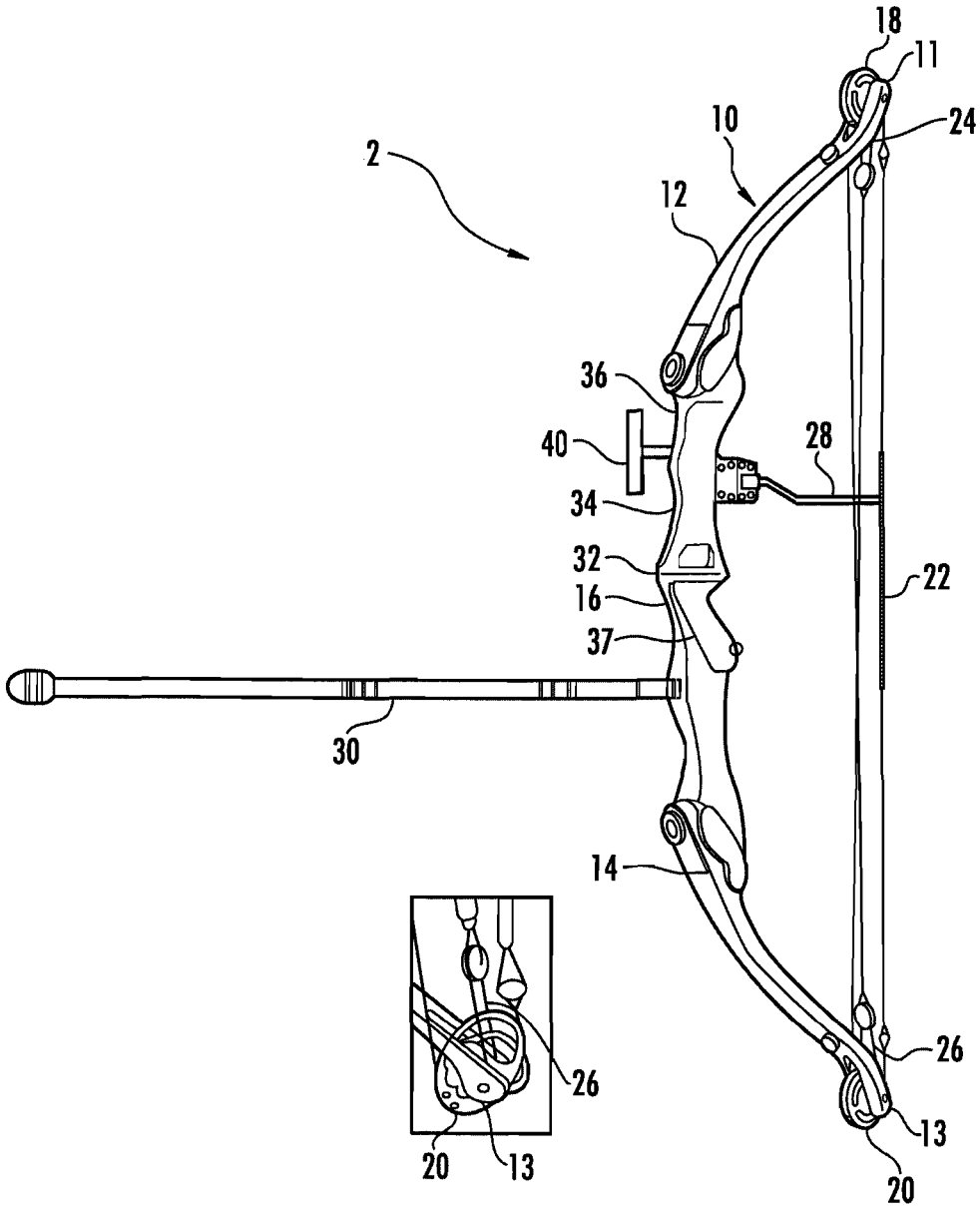
FIG. 1 (PRIOR ART)
FIG. 1 is a side view of a conventional compound bow.

FIG. 1 shows a conventional compound bow 2. The bow 2 includes a frame 10 having an upper limb 12 and lower limb 14 connected to a central portion 16, typically by bolts. An eccentric pulley 18 is located on the upper limb 12 at one end 11 of the frame 10, and a cam 20 is located on the lower limb 14 at an opposite end 13 of the frame 10.

The pulley 18 and cam 20 are rotatably mounted at upper 11 and lower ends 13 of the frame 10. In the illustrated example, the ends 11, 13 are forked, with axles extending therethrough that rotatably support the pulley 18 and cam 20. In alternative configurations, the locations of the pulley 18 and cam 20 could be reversed, or the bow 2 could be provided with pulleys 18 or cams 20 at both ends of the frame 10. A bow cable 22 has first 24 and second ends 26 respectively attached to the eccentric pulley 18 and cam 20. As shown, the cable 22 extends from the a point of attachment of the first end 24 to the cam 20, upwards and around a track formed in the eccentric pulley 18, then downwards and around a track formed in the cam 20, and back upwards to a point of attachment of the second end 26 to the eccentric pulley. A cable guard 28 may be provided, protruding from the center portion 16 of the frame to provide clearance between the inner portions of the cable 22 and an arrow during firing.

When the bow cable 22 is drawn, the limbs 12, 14 are pulled inwards and store energy until the archer "lets off." The pulley system permits the cable 22 to be drawn using less energy, which enables the archer to hold the bow cable 22 fully drawn and take more time to aim.

Still referring to FIG. 1, the central portion 16 of the frame 10 includes a center stabilizer 30 that is used to produce a better balance of weight and reduce vibration and shock during use of the bow 2. A section of the central portion 16 forms a handle riser 36, including a grip 37, which is grasped by an archer when firing an arrow. An arrow shelf 32 is provided in the riser 36 for guiding the arrow. A sight 40 is mounted on the riser 36, and a sight window 34 is located slightly below the sight 40. The sight window 34 is an opening in the riser through which the archer can view the sight 40.

Figure 2:
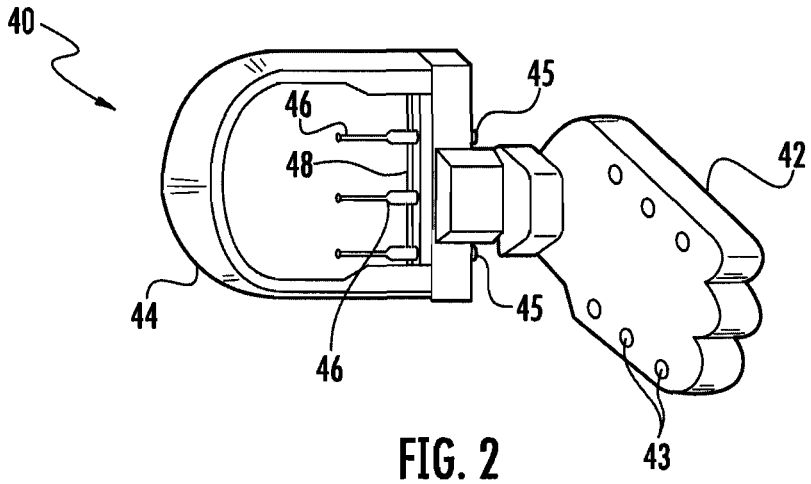
FIG. 2 (PRIOR ART)
FIG. 2 is a detailed perspective view of the site of the compound bow of FIG. 1.

FIG. 2 shows a detail of a conventional sight 40. The sight 40 is affixed to the riser 36 by a mounting bracket 42. In the illustrated example, the mounting bracket 42 includes holes 43 that receive fasteners for attachment to the riser 36, but other means of attachment are known in the art and may be employed as well. An aiming ring or pin guard 44 is affixed to an end of mounting bracket 42, opposite the end affixed to the riser 36, and is located in visual alignment with the sight window 34, from the perspective of an archer aiming the bow 2. A plurality of alignment members, in this case pins 46, are movably mounted within the aiming ring 44. In the illustrated example, this is achieved by mounting the pins 46 on a vertical track 48; however, other means for movably mounting the pins 46 may be utilized as well, and would be known to a person of ordinary skill in the art.

Each pin 46 is positioned such that it can be visually aligned with a target located a selected distance from the sight 40 in order to aim at that target. The pins 46 may be repositioned, to vary the distance between the sight 40 and an object aligned with it. In the illustrated example, the pins 46 can be repositioned by sliding along the track 48. The pins 46 may include fasteners 45, for example threaded fasteners, affixed outside the aiming ring 44, which can be loosened to permit sliding along the track 48, and tightened, to hold the pin 46 in a fixed position along the track 48. Alternative sight constructions are know in the art, and may vary from that described above, for example, including lasers, cross hairs, or other types of alignment members. Such variations are known to a person of ordinary skill in the art, and may be employed without departing from the scope of the claimed invention.

Figure 3:
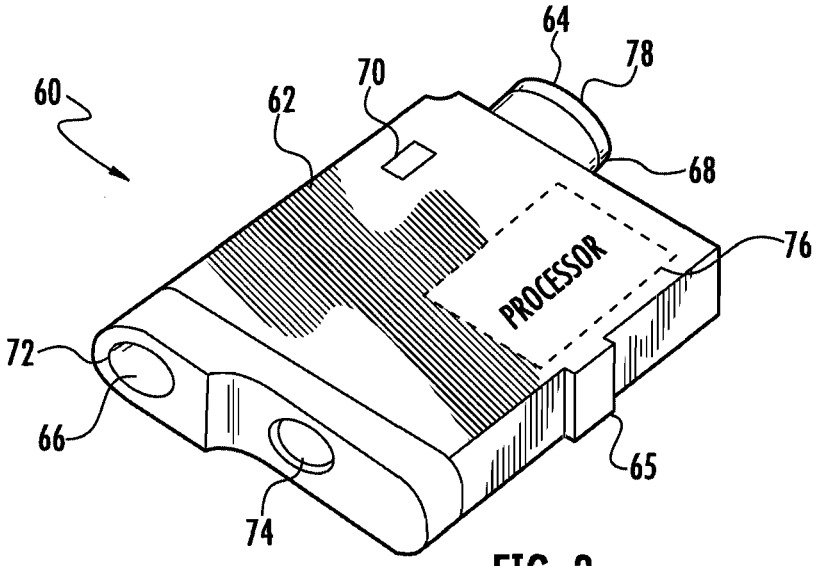
FIG. 3 (PRIOR ART)
FIG. 3 is a perspective view of a conventional range finder for use with a conventional compound bow.

FIG. 3 shows a conventional range finder 60, used to determine the range, or distance from a target. The range finder 60 includes a housing 62, which may have an attached mount 65, for affixing to a structure, such as a tripod, that supports the range finder 60 at a location near the bow 2. The housing 62 also includes a viewfinder 64, in the form of an opening in the housing 62, which communicates with at least one lens 66 located on an opposite side of the housing 62, and through which the archer looks to aim the range finder 60 at a selected target. The range finder 60 may also include an magnification dial 68 for repositioning the lens 66 to magnify objects viewed in the viewfinder 64. An actuating button 70 activates a laser transmitter 72, which fires a laser beam at the target. The laser beam is then reflected off of the target, and received by a laser receiver 74 of the range finder 60. A processor 76, located within the housing 62 and shown in phantom in FIG. 3, records the time between transmission and receipt of the laser beam to determine the distance to the target. The distance is shown in a display 78, provided within the viewfinder 64 in the example shown. The processor 76 and display 78 are supplied with power by batteries provided within a battery compartment defined within the housing 62. Alternative types of range finders that calculate the distance to the target using other means, such as recording the time between transmission and receipt of sound or radio waves are known in the art, and may be employed as well.

Once the range has been determined, the archer must often readjust the sight 40. In the illustrated example, this involves loosing a fastener 45 one of the pins 46, followed by moving the pin 46 to a different point along the track 48, and then tightening the fastener 45 to fix the pin 46 in the new position. All the while, the archer will need to keep an eye on the target. If the target moves to another distance, the entire process needs to be repeated. The archer must then use the range finder 60 to determine the new distance and readjust the sight 40 accordingly.

Figure 4:
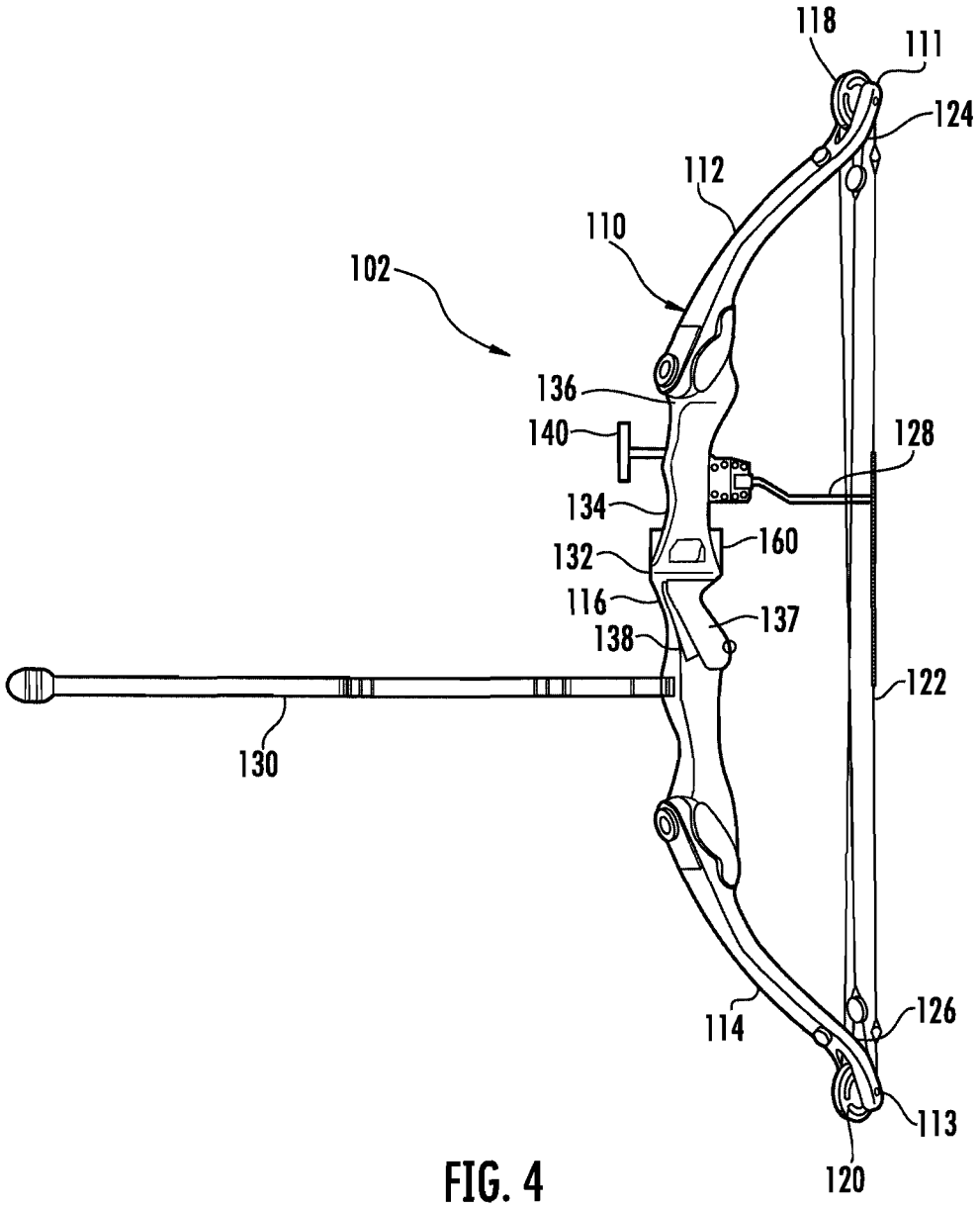
FIG. 4 is a perspective view of a compound bow with an electronically adjusted bow sight and range finder.

FIG. 4 shows an embodiment of a compound bow 102 with an electronically adjusted bow sight 140 and range finder 160. The basic construction of the bow 102, sight 140, and range finder 160 is the same as that described above. Other constructions would be within the purview of a person of ordinary skill in the art and are considered within the scope of the invention. Only the differences from the conventional devices described above will be discussed in detail, and elements corresponding to those described above will be designated using the same reference numbers, increased by one-hundred.

As shown in FIG. 4, the electronic range finder 160 is incorporated within the design of the bow 102. Alternatively, the range finder 160 may be provided as a separate element, or may include means for removable attachment to the bow 102. As shown, the frame 110 of the bow 102 is preferably provided with a hand trigger 138 that the archer actuates when the range finder 160 is fixed on a target. The trigger 138 is preferably affixed to the grip 137, and is shown being gripped by the hand 139 of an archer in FIG. 9. The range finder 160 then calculates the distance to the target in the manner described above. Upon determining the distance, the bow sight 140 automatically adjusts, as discussed in further detail below. The automatic adjustment of the sight 140 ensures that the archer need not waste time manually adjusting, thus allowing for a faster shot.

Figure 5:
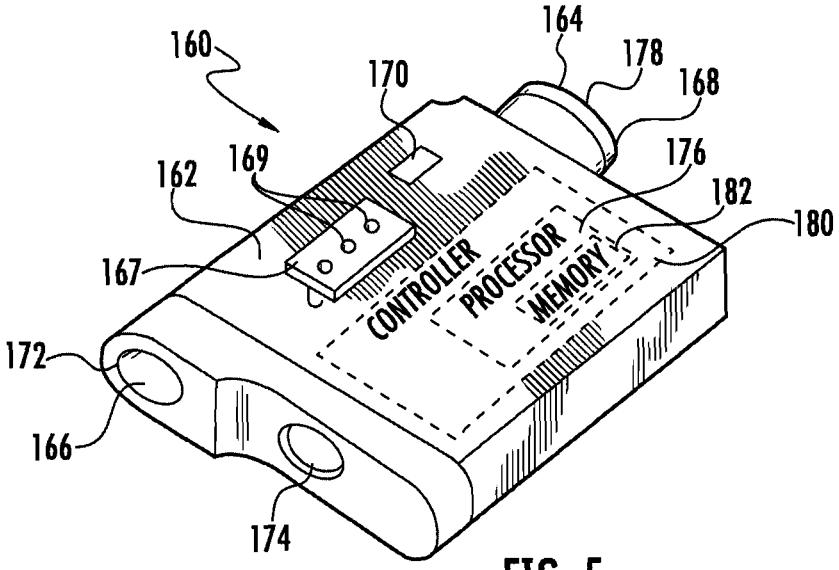
FIG. 5 is a detail of the electronic range finder of FIG. 4.

FIG. 5 shows perspective view of the electronic range finder 160 of FIG. 4. In addition to the elements described above, and shown in FIG. 3, the processor 176 includes a memory 182. The memory 182 and processor 176 may be included in a controller 180. When the range finder 160 is actuated by the hand trigger 138, the distance to the target is calculated and recorded in the memory 182, which may be configured to store a history of ranges calculated. A signal indicating the distance is transmitted from the processor 176 to the electronic sight 140.

The range finder 160 of FIG. 5 is provided with a mounting bracket 167 for affixation to a portion of the bow frame 110, instead of a mount 65 for affixing the prior art range finder 60 to an outside structure. In the embodiment of FIG. 5, the mounting bracket 167 includes holes 169 that receive fasteners to attach the range finder 160 to the frame 110, however, equivalent means for affixing the range finder 160 to a bow frame 110 would be easily recognized to a person of ordinary skill in the art.

Figure 6:
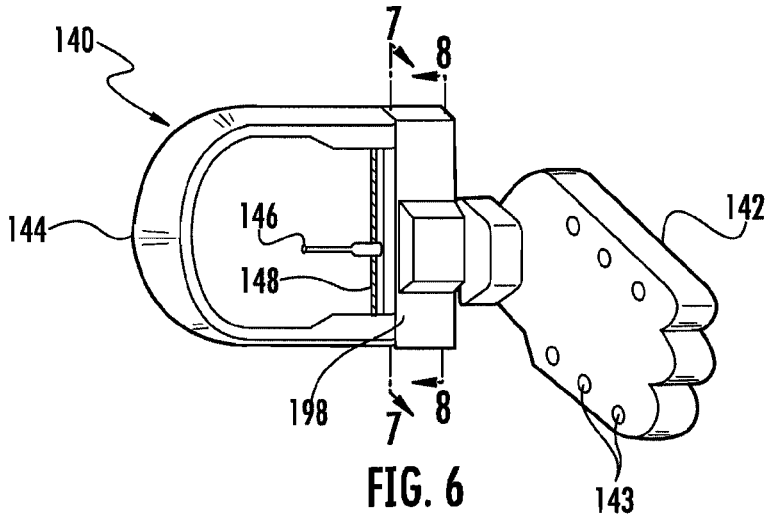
FIG. 6 is a detail of the electronically adjusted bow sight of FIG. 4.

FIG. 6 shows a detail of the electronic sight 140 of FIG. 4. The sight 140 is constructed in essentially the same manner as that described above with respect to FIG. 2, but alternative constructions known in the art may be employed without departing from the scope of the invention. The sight 140 of FIG. 6 differs from that described above and shown in FIG. 2 in that only a single pin 146 is provided, and the fastener 45 system for repositioning the pin 146 is omitted, a drive assembly 190 being provided in its place. The drive assembly 190 of the embodiment of FIG. 6 is provided within a housing 198 along the side of the aiming ring 144 that joins the mounting bracket 142.

Figure 7:
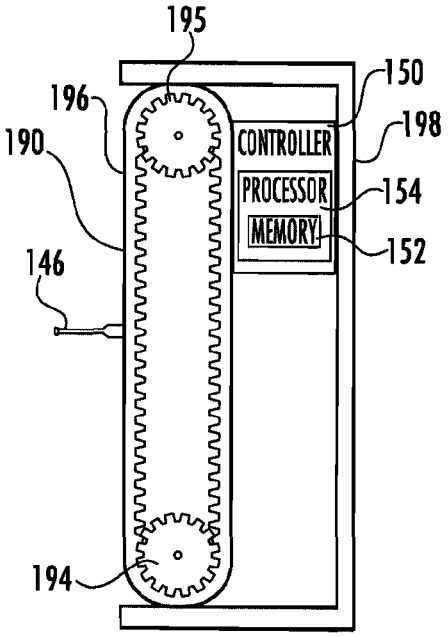
FIG. 7 is a cross section taken along line 7-7 of FIG. 6, showing the drive assembly and controller of the sight.
Figure 8:
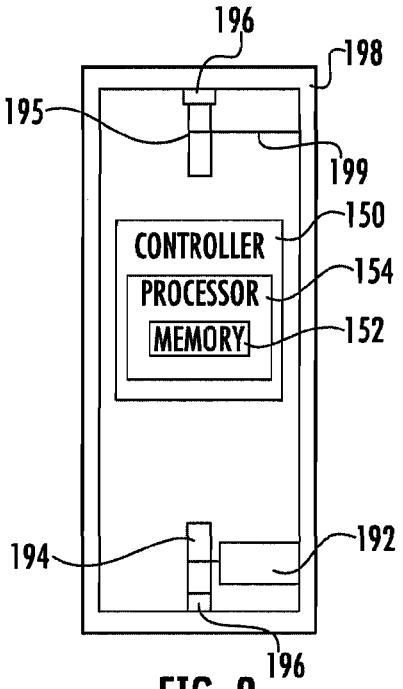
FIG. 8 is a cross section taken along line 8-8 of FIG. 6, showing the drive assembly and controller of the sight.
Figure 9:
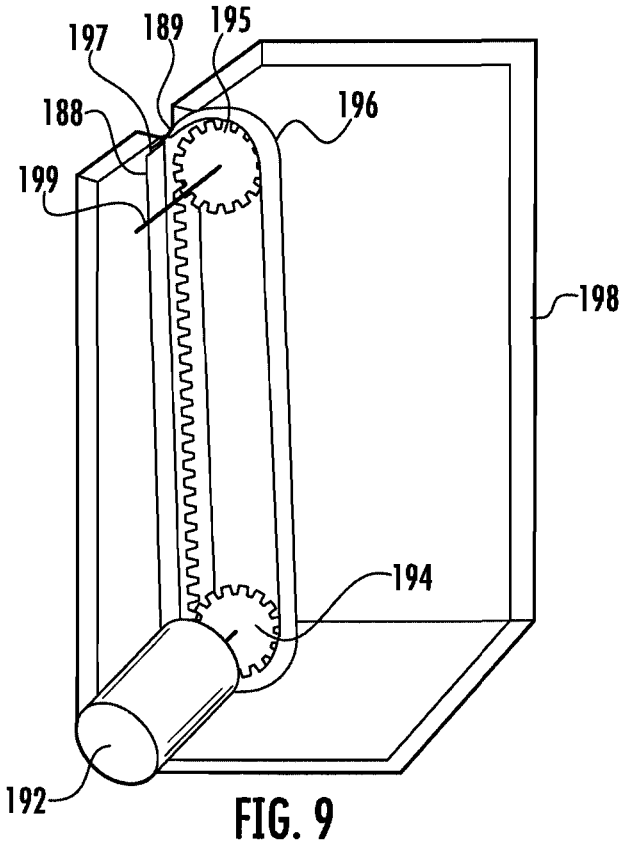
FIG. 9 is a partially cut-away perspective view, showing the interior of the housing of the sight.

FIGS. 7-9 show the drive assembly 190 of one embodiment. In the embodiment shown, the drive assembly 190 is a toothed belt drive. An electric motor 192, shown in FIGS. 8 and 9, is affixed to the interior of the housing 198. The motor 192 rotates a drive gear 194, provided at a lower end of the housing 198, which drives a toothed belt 196. A driven gear 195 is rotatably mounted on an axle 199 at an upper end of the housing 198 to provide support for the belt 196. The pin 146 is mounted on an outer surface of the belt 196, extends into the aiming ring 144, and is moved up or down by the belt 196 when driven by the drive gear 194. As shown in FIG. 9, the pin 146 moves along a track 148 defined in the housing 198. In the embodiment shown, the track 148 is formed from a vertical slot 189 defined in a wall of the housing and grooves 188 extending along opposite sides of the slot 189. Sides 197 of the belt 196 are retained and within the grooves 188, as the belt is driven by the motor 192. Alternative embodiments may use other drive assemblies, such as a drive screw assembly, worm drive, or rack and pinion. Such drive assemblies could be easily adapted for use in the sight 140 by a person of ordinary skill in the art.

In another embodiment, multiple pins 146 are provided, as in the sight 140 of FIG. 2. The pins 146 may all be driven by a common drive assembly 190, or separate drive assemblies 190 may be provided for each pin 146. For example, the pins 146 may be mounted at spaced apart intervals along the same drive belt 196, or may be driven by separate toothed belt drives 190 along separate tracks 146. In further embodiments, other types of alignment members may be provided in place of the pin 146. For example, horizontal and vertical cross-hairs may be provided, and each may be provided with a drive assembly.

Referring to FIGS. 7 and 8, the sight 140 is further provided with a controller 150, such as a printed circuit board, including a processor 154, and memory 152. In alternative embodiments, a single controller, processor, and memory may be provided for controlling both the sight 140 and range finder 160. The processor 154 receives the signal from the range finder 160 indicating the range of the target, and calculates the proper position for the sight 140 based on the distance from the target. The processor 154 then transmits a signal to the drive assembly 190 to adjust the sight 140 to the proper position. Where multiple pins 146 are provided, the sight may be configured to adjust the pin 146 already closest to the proper position, or a specific pin may be selected through manual control means provided in the sight 140.

Figure 10:
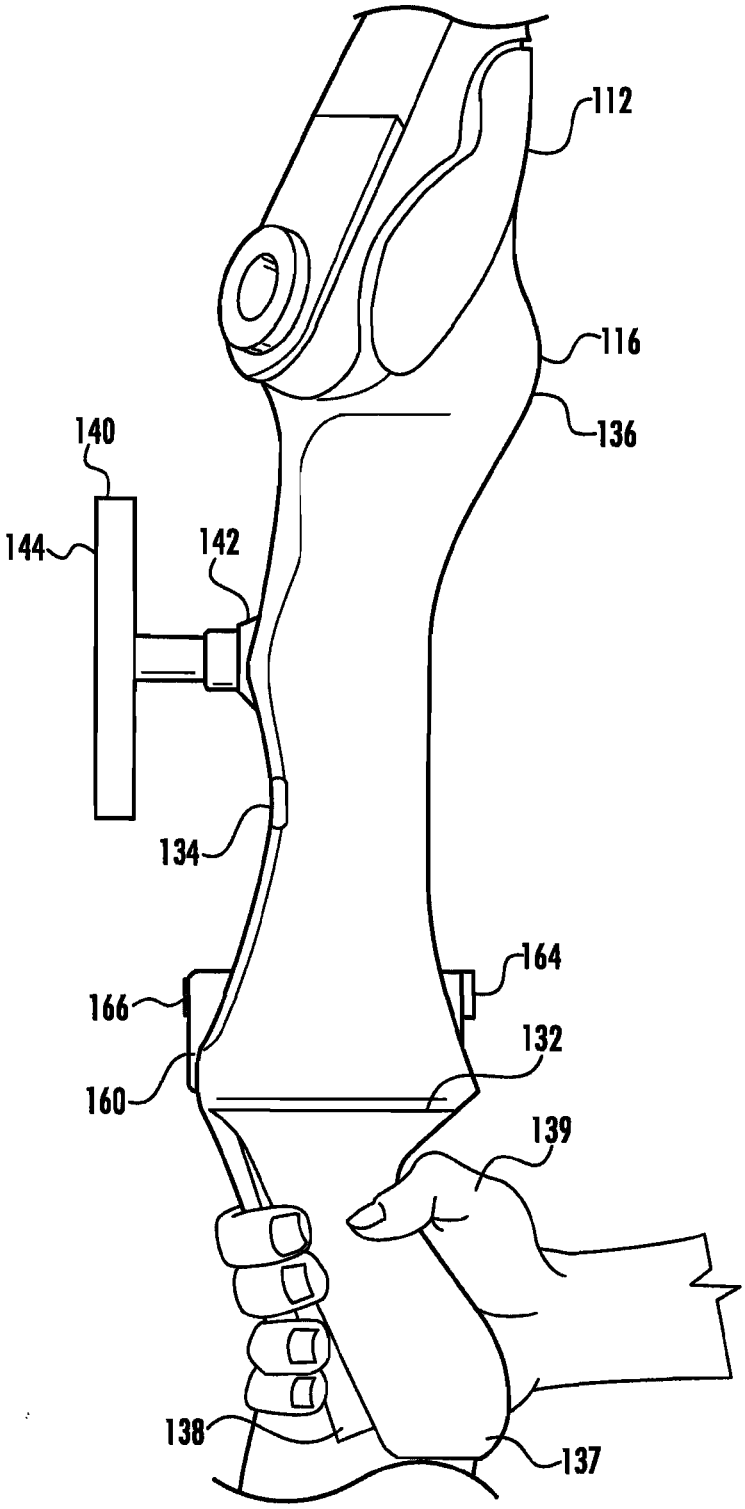
FIG. 10 is a detail of the riser of the bow of FIG. 4.

FIG. 10 shows a detail of the handle riser 136 of the bow 102 of FIG. 3. As shown, the riser 136 is modified to support the electronic sight 140 and range finder 160, without impeding the vision of the archer. In the illustrated embodiment, this is achieved by mounting the range finder 160 below the sight 140 and above the grip 137, on the opposite side as that of the arrow shelf 132; however, a person of ordinary skill in the art would recognize alternative locations for mounting the range finder 160, all of which are considered within the scope of the invention. In addition to a clear line of vision, the weight and balance of the bow 102 is also critical. Typically once a bow 102 is equipped with the chosen accessories, the center stabilizer 130 is placed below the shelf 132 in order to achieve maximum stability. In an alternative embodiment, the riser 136 is provided with an opening that receives the range finder 160. In yet another embodiment, the riser may be provided with one or more inserts or openings that house the one or both processors 154, 176, which may be provided separate from the sight 140 and range finder 160. Such a configuration ensures that all of the components can be stowed on the frame 110 of the bow 102 without diminishing the view of the archer.

According to one embodiment, the electronic range finder 160 is configured to create a "zero reading" at 20 yards. An archer will typically aim for target in the range of 20 to 40 yards. Upon power up, the electronic sight 140 is preconfigured for aiming at a target that is 20 yards away. This zero reading is stored within the range finder memory 182, but may alternatively be stored in the sight memory 152. Accordingly, when the electronic range finder 160 takes a measurement, the processor 176 compares the range with the "zero reading" to determine the total adjustment needed for the electronic sight 140. After the electronic site 140 is adjusted for the new range, the new range may be set as the "zero reading."

Figure 11:
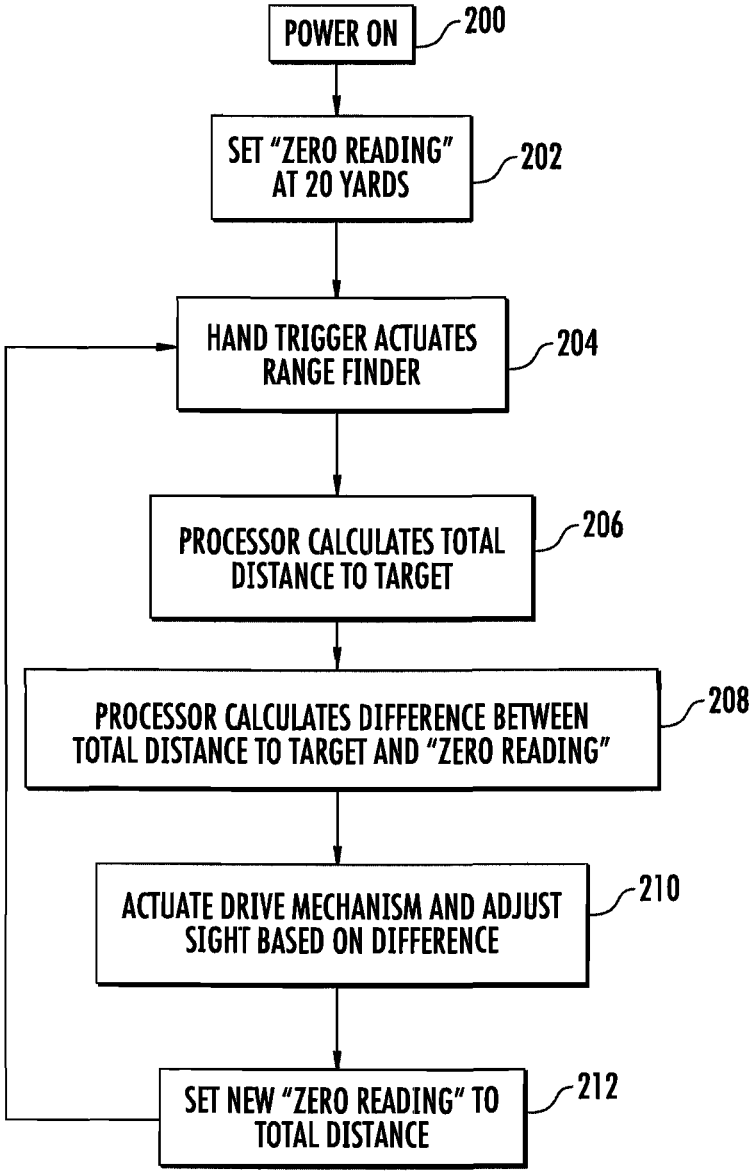
FIG. 11 is a flow diagram of a process for electronic site adjustment using the electronically adjusted bow sight and range finder.

FIG. 11 shows a flow diagram of one embodiment of the range adjusting process using an electronic sight 140 and range finder 160. First the components are powered on (200). This may take place by switching on of one or more power buttons located on the range finder 160, sight 140, or frame 110 of the bow 102. Upon initialization, the "zero reading" is set to a distance of 20 yards (202). The hand trigger 138 then actuates the range finder 160 (204). Next the processor 176 of the range finder 160 calculates the total distance to the target (206), and then calculates the difference between the total distance and the zero reading to determine the adjustment required of the electronic site 140 (208). The drive mechanism 190 is then actuated, to adjust the electronic site 140 based on the difference (210). Once the electronic site 140 is adjusted, the zero reading is reset to the total distance last measured (212). In an alternative embodiment, however, the zero reading can remain at 20 yards, and the electronic sight 140 can return to such a position after each shot.

Although the invention is described as implemented in a compound bow, it should be understood that it may be implemented into other types of bows or projectile launching devices, which would be easily recognizable to a person of ordinary skill in the art. Additionally, although features and elements are described above in particular combinations, each feature or element can be used alone without the other features and elements or in various combinations with or without other features and elements.

What is claimed is:

1. An archery sight alignment and range finder comprising:

a selectively activated signal emitting range finder to determine an initial zero setting for a distance from an archery device to a target that is between twenty and thirty yards from the archery device;

a sight alignment member to align a projectile associated with the archery device with the target;

a drive assembly to move the sight alignment member; and a processor to control movement of the drive assembly, the sight alignment member and projectile in response to the emitted range finder signal returned from the target upon a subsequent activation of the signal emitting range finder.

2. The archery sight alignment and range finder of claim 1 further comprising a trigger to actuate the archery sight alignment and range finder.

3. The archery sight alignment and range finder of claim 1 wherein the processor includes a memory.

4. The archery sight alignment and range finder of claim 3 wherein the memory stores a distance history.

5. An archery sight alignment and range finder comprising:

a signal emitting range finder for determining a distance to a target from an archery device and has initialized zero setting that is between twenty and thirty yards from the archery device;

a sight alignment member for aligning a projectile associated with the archery device with the target;

a drive assembly that moves the sight alignment member; and a processor that actuates the drive assembly to move the sight alignment member and projectile in response to the emitted range finder signal returned from the target.

* * * * *